United States Patent [19]

Coenen et al.

[11] Patent Number: 4,642,401

[45] Date of Patent: Feb. 10, 1987

[54] PROCESS FOR THE PRODUCTION OF LIQUID HYDROCARBONS

[75] Inventors: Hubert Coenen; Rainer Hagen, both of Essen, Fed. Rep. of Germany

[73] Assignee: Fried. Krupp Gesellschaft mit beschrankter Haftung, Fed. Rep. of Germany

[21] Appl. No.: 631,420

[22] Filed: Jul. 16, 1984

[30] Foreign Application Priority Data

Jul. 21, 1983 [DE] Fed. Rep. of Germany ..... 3326284

[51] Int. Cl.[4] ..... C07C 4/04

[52] U.S. Cl. ..... 585/241; 201/21; 201/25

[58] Field of Search ..... 585/240, 241; 201/21, 201/25, 28, 36, 2.5, 3.4; 44/62

[56] References Cited

U.S. PATENT DOCUMENTS

| | | | |
|---|---|---|---|
| 3,704,108 | 11/1972 | Alpert | 585/341 |
| 3,901,951 | 8/1975 | Nishizaki | 585/241 |
| 3,974,206 | 8/1976 | Tatsumi et al. | 585/241 |
| 4,118,281 | 10/1978 | Yan | 201/2.5 |
| 4,175,211 | 11/1979 | Chen et al. | 201/2.5 |
| 4,235,676 | 11/1980 | Chambers | 201/21 |
| 4,327,237 | 4/1982 | Imparato et al. | 585/241 |
| 4,384,150 | 5/1983 | Lyakhevich et al. | 585/241 |
| 4,384,151 | 5/1983 | Audibert et al. | 585/241 |
| 4,426,459 | 1/1984 | Watabe et al. | 585/241 |
| 4,429,172 | 1/1984 | Zellerhoff et al. | 585/241 |
| 4,463,203 | 7/1984 | Gi | 585/241 |
| 4,552,621 | 11/1985 | Lyakhevich et al. | 585/241 |

*Primary Examiner*—Andrew H. Metz
*Assistant Examiner*—Anthony McFarland
*Attorney, Agent, or Firm*—Sughrue, Mion, Zinn, Macpeak, and Seas

[57] ABSTRACT

A process for the production of liquid hydrocarbons from old tires, cable wastes, polyethylene wastes and/or polypropylene wastes, by which the waste products, in pulverized form, are treated at a temperature of 150° to 500° C. and a pressure 20 to 300 bar with a solvent which is liquid at 1 bar and 20° C. to form a solvent phase charged with liquid hydrocarbons and a residue phase. The charged solvent phase is separated from the residue, and the separated charged solvent phase is resolved into its components by lowering of pressure and/or temperature, and by distillation.

6 Claims, 1 Drawing Figure

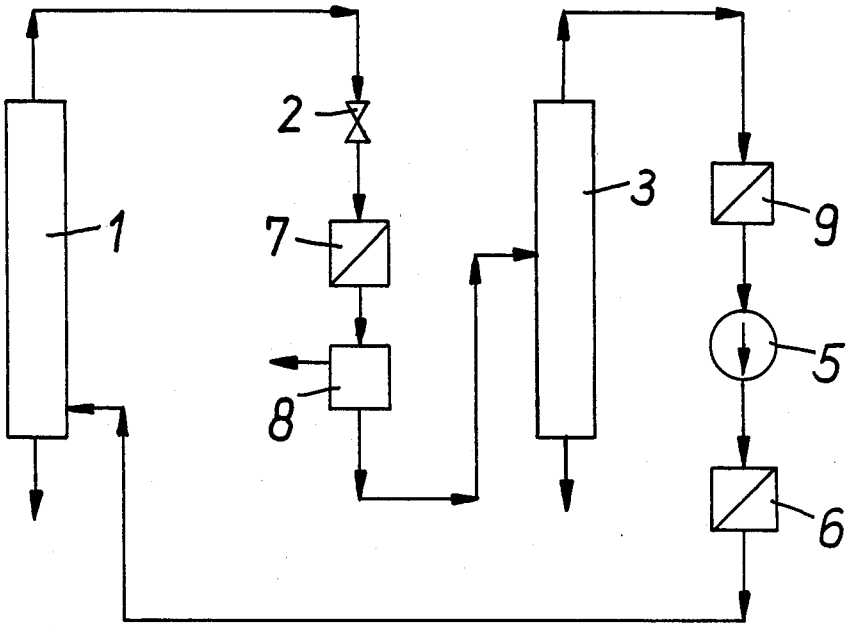
1
2
7
8
3
9
5
6

PROCESS FOR THE PRODUCTION OF LIQUID HYDROCARBONS

BACKGROUND OF THE INVENTION

The present invention relates to a process for the production of liquid hydrocarbons from old tires, cable wastes, polyethylene wastes and/or polypropylene wastes. Among the liquid hydrocarbons, which are produced according to this process, are alkanes, cycloalkanes and aromatic substances, which have a boiling point from 20° to about 350° C. and whose molecules contain 5 to about 30 carbon atoms. The liquid hydrocarbons produced according to the invention can contain organic sulfur- and chlorine-compounds, depending on the sulfur and chlorine content of the old tires. The liquid hydrocarbons can be used as heating oil or for the mixing of heating oil, respectively, or for chemical raw materials.

Old tires are part of the waste products of the motor vehicle industry and comprise one or more rubber mixtures, a bead ring and woven material. The rubber mixture generally comprises rubber, carbon black, oils and resins, zinc oxide, a vulcanization accelerator, preservatives and sulfur. The rubber generally comprises chain-form macromolecules, which entwine among each other and in addition are linked through sulfur atoms. Tire production is carried out by using natural rubber and synthetic rubber, wherein the synthetic rubber types are developed through polymerisation of isoprene, butadiene, chlorobutadiene and copolymerisation of butadiene with styrene or isobutene with isoprene. The carbon black serves as a filler and for the improvement of the rubber characteristics, because it forms a very close bond with the rubber during the production of the tire. The oils and resins function as a plasticizer and improve the working property of the rubber mixture. The zinc oxide serves as a filler and as an activating agent for the vulcanization accelerator. The bead ring stabilizes the tires against radial forces and consists of steel wire or steel cord. The woven material present in the tire comprises synthetic fibers or steel wires. The weight percentage of the rubber mixture in old tires usually is between 75 and 80%.

Cable wastes are developed by the fabrication and repair of cables which comprises a metallic electric conductor and a synthetic insulation as well as a synthetic sheath and are used for the transmittal of news or electric energy.

Polyethylene- and polypropylene- wastes are developed by the production of synthetics and the processing of synthetics and are obtained in those cases in a relatively pure form. Polyethylene and polypropylene are produced by polymerisation of ethylene or propylene, respectively, and contain, along with the polymers, additional fillers.

The harmless disposal of old tires is difficult and expensive. Old tires today are usually disposed of by burning, which occurs either in especially constructed ovens or in waste burning facilities. The waste gases of the waste burning facilities, in which old tires are burned, must be dedusted and desulfurated, especially because of the high ZnO— and $SO_2$ content. Moreover, it is known that old tires can be disposed of through a pyrolysis process and processed to reusable products. Through the pyrolysis of old tires are produced a pyrolysis coke, a burnable pyrolysis gas, that mostly serves to provide the intrinsic energy requirement of the pyrolysis process, and a pyrolysis oil, that is used as heating oil. The polyethylene- and polypropylene wastes are usually burned. The cable wastes are ususally dumped in a waste deposit.

The burning processes have the disadvantage that they are difficult to carry out because of the natures of old tires and synthetic wastes and that the burning waste gases must be purified with expensive processes. The disadvantage of the pyrolysis process is that a very large part of the organic compounds, valuable in themselves, carbonizes and is thereby transformed into a less valuable form.

SUMMARY OF THE INVENTION

An object of the present invention is to provide a process by which old tires, cable-, polyethylene- and/or polypropylene wastes can be harmlessly disposed of and can be processed to valuable reusable liquid hydrocarbons, by which the development of gaseous and coke-like decomposition products are to be largely avoided.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for producing liquid hydrocarbons from old tires, cable waste, polyethylene waste, polypropylene waste, or mixtures thereof, by treating pulverized old tires, cable waste, polyethylene waste, polypropylene waste, or mixtures thereof, at a temperature of 150° to 500° C. and a pressure of 20 to 300 bar with a solvent which is liquid at 1 bar and 20° C. to form a solvent phase which is charged with liquid hydrocarbons and a residue phase; separating the solvent phase which is charged with liquid hydrocarbons from the residue phase; resolving the separated solvent phase into its components by lowering its pressure or by lowering its pressure and temperature, and by subjecting it to distillation; recovering solvent during the resolving of the separated solvent phase, and recycling the recovered solvent.

Under the influence of high pressure and high temperature a splitting of the polymer molecule occurs, whereby in particular, liquid hydrocarbons are formed with about 5 to 30 carbon atoms, without a significant carbonization taking place.

It is to be understood that both the foregoing general description and the following detailed description are exemplary, but are not restrictive of the invention.

BRIEF DESCRIPTION OF THE DRAWING

The sole FIGURE of the drawing schematically illustrates an apparatus in which the process of the present invention can be performed.

DETAILED DESCRIPTION OF THE INVENTION

In the practice of the present invention, pulverized wastes, in particular, old tires, cable waste, polyethylene waste, polypropylene waste, or mixtures thereof, are treated with a solvent to provide liquid hydrocarbons. The pulverization can be achieved by conventional means to provide particles of, for example, 2 cm in length. The different types of wastes can be treated individually by themselves or in mixture with each other. When mixtures are used, the wastes can be mixed in any amounts with each other, and two or more types of wastes can be mixed with each other.

As discussed above, polyethylene wastes and polypropylene wastes are developed by the production of synthetics and the processing of synthetics and are obtained in those cases in a relatively pure form. These pure wastes can be processed to liquid hydrocarbons by the process according to the present invention, while those in household waste containing polyethylene- and polypropylene wastes cannot be used as a feed in the process according to the present invention because it is difficult to separate them from the other synthetics contained in household waste, especially polyvinylchloride.

In the practice of the present invention, the wastes are treated at a temperature of 150° to 500° C. especially at 400° C., and a pressure of 20 to 300 bar especially at 250 bar with a solvent which is liquid at 1 bar and 20° C. to form a solvent phase charged with liquid hydrocarbons and a residue phase. Under the influence of the high pressure and high temperature, a splitting of the polymer molecule of the wastes occurs, whereby in particular, liquid hydrocarbons are formed with about 5 to 30 carbon atoms, without significant carbonization taking place.

The liquid hydrocarbons are absorbed by the solvent relatively quickly and transported away. The plasticizer and preservative absorbed by the solvent under the influence of the pressure and the temperature are decomposed only to a limited extent. The carbon black, the filler, the metals and the woven material are left as a solid insoluble residue, which also contains the small amount of the coking product which possibly is produced by the process. The process of the present invention has the advantage that the largest part of the organic compounds present in the waste products is converted into liquid reusable hydrocarbons. Among the liquid hydrocarbons, which are produced according to this process, are alkanes, cycloalkanes and aromatic substances, which have a boiling point from 20° to about 350° C. and whose molecules contain 5 to about 30 carbon atoms. The liquid hydrocarbons produced according to the invention can contain organic sulfur- and chlorine-compounds, depending on the sulfur and chlorine content of the old tires. The liquid hydrocarbons can be used as heating oil or for the mixing of heating oil, respectively, or for chemical raw materials.

The process according to the present invention can be especially successfully carried out when benzene, naptha, toluene, xylene, ethylbenzene and/or water are used as the solvent, and the weight ratio of the waste products to the solvent is between 1:3 and 1:30 especially 1:10. The organic solvents to be used according to the invention have an optimal dissolving capacity for the liquid hydrocarbons formed, while the water to be used according to the present invention supplies products with lower molecular weight.

In the practice of the present invention, the solvent phase charged with the liquid hydrocarbons is separated from the residue phase by gravity, and the separated solvent phase is then resolved into its constituents, by stepwise lowering the pressure or by stepwise lowering the pressure and temperature of the separated solvent phase to separate a gas fraction and several low boiling liquid hydrocarbons from the solvent phase, and to separate the other hydrocarbons from the solvent phase by subjecting it to distillation.

In a preferred embodiment of the present invention, the lowering of pressure and temperature occurs in several steps, so that the components of the charged solvent phase are separated in several steps to produce several fractions. By conducting the process in this manner, it is possible to separate the liquid hydrocarbons into fractions suitable for different uses. Moreover, a suitable fraction obtained by the process according to the present invention can be resupplied as a solvent.

Referring now to the drawing, there is shown an apparatus for practicing the invention, in which, for example, a charge of pulverized old tires, cable waste, polyethylene waste and/or polypropylene waste is introduced into a reactor 1. The sulfur- and chlorine content of the old tires is thinned in an advantageous way by the polyethylene- and polypropylene wastes. The solvent is heated in a heat exchanger 6 to the process temperature of 150° to 500° C. and is brought to the process pressure of 20 to 300 bar, as well as pumped into reactor 1 by a compressor 5. The solvent flows through reactor 1 and draws off the liquid hydrocarbon formed in reactor 1, as well as the gaseous reaction products which have been formed in small amounts. The solvent phase, charged with the liquid hydrocarbon, is taken off at the head or top of reactor 1, is expanded in a pressure-relieving valve 2, is cooled down in a heat exchanger 7, is freed from the gaseous reaction product in a separation vessel 8, and finally is fed to a distillation column 3. The higher boiling hydrocarbons are taken off at the foot of distillation column 3, while a lower boiling fraction containing the lower boiling hydrocarbons together with the solvent is removed at the head of distillation column 3. The lower boiling fraction is then cooled off in a heat exchanger 9 and is fed into reactor 1 after liquefication in compressor 5. It is possible to carry out the expansion and cooling of the solvent phase charged with the liquid hydrocarbons in several steps, which is not pictured in the drawing. The solid residue is removed from reactor 1, which contains the insoluble components of the waste products used as well as the coking products.

The following examples are given by way of illustration to further explain the principles of the invention. These examples are merely illustrative and are not to be understood as limiting the scope and underlying principles of the inventors in any way. All percentages referred to herein are by weight unless otherwise indicated.

EXAMPLE 1

Old tires (50% by weight) and cable wastes (50% by weight) were reduced to small pieces so that particles with a length of about 2 cm were obtained. 602 g of these particles were treated in a reactor for 4 hours with toluene at 350° C. and 80 bar. Thereafter, the solvent phase charged with the liquid hydrocarbon was separated and expanded to 10 bar and cooled at 310° C. By this means, a separation into a liquid phase containing 2220 g toulene and 392 g liquid hydrocarbons and into a gas phase, consisting mainly of toulene (7003 g), was achieved. The liquid phase, which contained approximately 85% toluene, was distilled to separate the toulene (2220 g) and the low boiling liquid hydrocarbons (1392 g), after expansion to atmospheric pressure. After the essentially quantitative separation of the toluene and low boiling liquid hydrocarbons, a large amount of extract remained, which amounted to 65.1 weight % of the particles used. The extract consisted overwhelmingly of aliphatic and aromatic liquid hydrocarbons and had a sulfur content of 1.43 weight %. Neither in the toluene-free extract nor in the distilled toluene were hydrocarbons formed with a molecule size under $C_{10}$, as a gas chromatography analysis showed. By an IR-spectroscopic examination of the extract, small amounts of chloro-hydrocarbons as well as organic acids and esters were identified. The viscosity of the extract was greater than 200 000 cP, the average molecular weight was 240 g/mol and the caloric value was determined to be 9000 kcal/kg.

The solid residue obtained in the reactor after the toulene treatment was powder and consisted mainly of carbon black, ZnO, other tire fillers and metal pieces. The sulfur content was 2.37%, while the sulfur content of the particles was about 1.70%.

In the toluene treatment, for 1 kg of starting waste material 12 kg of toluene was used, which can be recovered to a large extent and recycled. The metals present in the starting waste material are found in the residue in an unaltered form. This is an advantage over the pyrolysis, which is conducted at higher temperatures. There are metals present in the old tires and cable wastes melt together in an undesirable fashion, whereas by the process according to the present invention, the metals can be sorted out by mechanical separation processes with little expenditure of energy by the process according to the present invention, and can be further utilized.

EXAMPLE 2

233 g of pulverized polyethylene were treated for 4 hours with 3 kg/h toluene at 80 bar and 315° C. As a result, practically the whole polyethylene amount was absorbed by the solvent phase. The solvent phase was then expanded to 1 bar and cooled to 90° C., and then was distilled for the separation of the toluene and the low boiling liquid hydrocarbons. The toluene could be almost quantitatively recovered by the distillation.

EXAMPLE 3

193 g of pulverized polypropylene were treated at 100 bar and 310° C. for 4 hours with 3 kg/h toluene. Practically all of the polypropylene was thereby absorbed by the solvent. After separation of the loaded solvent phase, it was expanded to 1 bar and cooled to 85° C., and then distilled for separation of the toluene. By the distillation the toluene can be almost quantitatively removed from the extract and recovered.

It will be understood that the above description of the present invention is susceptible to various modifications, changes, and adaptations, and the same are intended to be comprehended within the meaning and range of equivalents of the appended claims.

The critical constants of the solvents are:

| | | Tc [°C.] | Pc [bar] |
|---|---|---|---|
| Benzin | $C_7H_{16}$ | .267 | 27,8 |
| Benzol | $C_6H_6$ | 288,1 | 49,5 |
| Athylbenzol | $C_8H_{10}$ | 344 | 38 |
| Toluol | $C_7H_8$ | 348,9 | 42,2 |
| o-xylol<br>m-xylol<br>p-xylol | xylol $C_8H_{10}$ | 351,8 | 35,9 |

-continued

| | Tc [°C.] | Pc [bar] |
|---|---|---|
| $H_2O$ | 374,15 | 221,29 |

What is claimed is:

1. Process for the production of liquid hydrocarbons from pulverized wastes in the form of pulverized old tires, cable wastes, polyethylene wastes, polypropylene wastes, and mixtures thereof, consisting essentially of treating the pulverized old tires, cable wastes, polyethylene wastes, polypropylene wastes, and mixtures thereof, in a reactor at a temperature of 150° to 500° C. and a pressure of 20 to 300 bar with a solvent which is liquid at 1 bar and 20° C. to form a solvent phase charged with liquid hydrocarbons and a residue phase, the solvent being selected from benzene, naptha, toluene, xylene, ethylbenzene, water, and mixtures thereof, and the weight ratio of the wastes to the solvent being between 1:3 and 1:30; separating the solvent phase charged with the liquid hydrocarbons from the residue phase by gravity, resolving the separated solvent phase into components, by lowering the pressure or by lowering the pressure and temperature of the solvent phase to separate a gas fraction and several low boiling liquid hydrocarbons from the solvent phase, and by subjecting the solvent phase, from which the gas fraction and said several low boiling liquid hydrocarbons have been separated, to distillation to separate other hydrocarbons from the solvent phase; recovering solvent during the resolving of the separated solvent phase; and recycling the recovered solvent to the reactor.

2. Process according to claim 1, wherein the resolving of the separated solvent phase into components is accomplished by lowering the temperature and pressure, said lowering of the temperature and pressure occuring in several steps.

3. Process according to claim 1, wherein the pressure during the treating is at least 80 bar.

4. Process for the production of liquid hydrocarbons from pulverized wastes in the form of pulverized old tires, cable wastes, polyethylene wastes, polypropylene wastes, and mixtures thereof, consisting essentially of: treating the pulverized old tires, cable wastes, polyethylene wastes, polypropylene wastes, and mixtures thereof, in a reactor at a temperature of 150° to 500° C. and a pressure of 20 to 300 bar with a solvent which is liquid at 1 bar and 20° C. to form a solvent phase charged with liquid hydrocarbons and a residue phase, the solvent being selected from benzene, naptha, toluene, xylene, ethylbenzene, water, and mixtures thereof, and the weight ratio of the wastes to the solvent being between 1:3 and 1:30; separating the solvent phase charged with the liquid hydrocarbons from the residue phase by gravity; and resolving the separated solvent phase into components, by lowering the pressure or by lowering the pressure and temperature of the solvent phase to separate a gas fraction and several low boiling liquid hydrocarbons from the solvent phase, and by subjecting the solvent phase, from which the gas fraction and said several low boiling liquid hydrocarbons have been separated, to distillation to separate other hydrocarbons from the solvent phase.

5. Process according to claim 4, wherein the resolving of the separated solvent phase into components is accomplished by lowering the temperature and pressure, said lowering of the temperature and pressure, said lowering of the temperature and pressure occuring in several steps.

6. Process according to claim 4, wherein the pressure during the treating is at least 80 bar.

* * * * *